US009962585B2

(12) United States Patent
Friesen

(10) Patent No.: US 9,962,585 B2
(45) Date of Patent: May 8, 2018

(54) STRIKING IMPLEMENT COMPRISING A CONSTRAINED FREQUENCY RESONATOR

(71) Applicant: ARIZONA BOARD OF REGENTS, A BODY CORPORATE OF THE STATE OF ARIZONA, ACTING FOR AND ON BEHALF OF ARIZONA STATE UNIVERSITY, Scottsdale, AZ (US)

(72) Inventor: Cody Friesen, Fort McDowell, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 0 days. days.

(21) Appl. No.: 15/104,927

(22) PCT Filed: Dec. 30, 2014

(86) PCT No.: PCT/US2014/072787
§ 371 (c)(1),
(2) Date: Jun. 15, 2016

(87) PCT Pub. No.: WO2015/103282
PCT Pub. Date: Jul. 9, 2015

(65) Prior Publication Data

US 2016/0310808 A1 Oct. 27, 2016

Related U.S. Application Data

(60) Provisional application No. 61/923,158, filed on Jan. 2, 2014.

(51) Int. Cl.
*A63B 60/00* (2015.01)
*A63B 53/08* (2015.01)
(Continued)

(52) U.S. Cl.
CPC ..... *A63B 60/00* (2015.10); *A63B 53/007* (2013.01); *A63B 53/08* (2013.01); *A63B 53/12* (2013.01);
(Continued)

(58) Field of Classification Search
CPC ..... A63B 53/12; A63B 53/10
(Continued)

(56) References Cited

U.S. PATENT DOCUMENTS 4,090,711 A 5/1978 Amato et al.
4,979,743 A 12/1990 Sears
(Continued)

FOREIGN PATENT DOCUMENTS

WO 2007/086676 A1 8/2007

OTHER PUBLICATIONS

International search report for PCT/US2014/072787, dated Mar. 20, 2015.

*Primary Examiner* — Alvin Hunter
*Assistant Examiner* — Rayshun Peng
(74) *Attorney, Agent, or Firm* — Quarles & Brady LLP

(57) ABSTRACT

A constrained frequency resonator is incorporated into the shaft of a striking implement for transferring and, advantageously, amplifying momentum from a striking end to a gripped end of the striking implement, thereby amplifying the sensation of a strike felt at the gripped end. The resonator has a substantially hourglass shape, with wide ends and a narrow waist, and is made of stainless steel or another very hard material. The shape of the resonator causes it to act as a vibration frequency filter that transfers and, preferably, amplifies a certain frequency or band of frequencies. The striking implement may be a golf club, pool cue, or other implement in which frequency transfer to a gripping section is desired.

20 Claims, 2 Drawing Sheets

(51) Int. Cl.
*A63B 53/00* (2015.01)
*A63B 53/12* (2015.01)
*A63D 15/08* (2006.01)

(52) U.S. Cl.
CPC ..... *A63D 15/083* (2013.01); *A63B 2060/002* (2015.10); *A63B 2209/00* (2013.01); *A63B 2243/002* (2013.01)

(58) Field of Classification Search
USPC ..... 473/516, 316, 318, 232, 226
See application file for complete search history.

(56) References Cited

U.S. PATENT DOCUMENTS 5,316,300 A * 5/1994 Simmons ..... A63B 53/10 473/318
5,332,225 A 7/1994 Ura
5,527,038 A 6/1996 Mabie
5,683,308 A 11/1997 Monelle
5,735,752 A * 4/1998 Antonious ..... A63B 53/10 473/317
5,928,090 A 7/1999 Cabales et al.
5,964,670 A * 10/1999 Cheng ..... A63B 53/10 473/319
6,007,431 A 12/1999 Bloom, Jr.
6,244,972 B1 6/2001 Drossos
6,641,489 B1 11/2003 Wright et al.
6,899,633 B1 5/2005 Kienzle
7,140,973 B2 * 11/2006 Rohrer ..... A63B 53/14 473/300
7,850,537 B2 12/2010 Stern
8,241,138 B2 8/2012 Maglaque et al.
2002/0147056 A1 * 10/2002 Sukenik ..... A63B 53/14 473/300
2004/0048683 A1 3/2004 Burrows
2004/0121850 A1 6/2004 Rohrer
2015/0290509 A1 10/2015 Rose

* cited by examiner

STRIKING IMPLEMENT COMPRISING A CONSTRAINED FREQUENCY RESONATOR

FIELD

The present invention is generally related to games wherein a player strikes a ball by a stroke, and more specifically to a striking implement for impelling a ball across a playing surface, wherein the striking implement comprises a vibratory wave amplifying feature.

BACKGROUND

In various games and sports, players strike a ball by a stroke or a number of strokes using a striking implement to advance the ball from a ball striking location to a hole, pocket, receptacle or target area of a playing surface. For example, the objective in the game of billiards or pool is to project a cue ball directly, via other cue balls or boundary rails into pockets by using a striking implement known as a cue. Another example is the game of golf, wherein the objective is to advance a golf ball into a putting hole in the fewest number of strokes with the use of a striking implement commonly known as a golf club.

Conventionally, golf clubs have been designed for appearance, pendular properties and to dampen impact vibrations felt by a golfers' hand upon a golf ball strike. For example, U.S. Pat. Nos. 5,683,308, 5,928,090, 5,964,670, 6,007,431, and 6,641,489 are all configured to dampen impact vibrations upon ball strike.

Conventional putters are configured to absorb, not transmit, impact vibrations. Putter design has focused, primarily, on head shape, weight and balance properties, which help guide the eye and provide for a more stable stroke. Commonly, the head is of dense metallic form, and is suitably heavy to serve as the pendulum bob in a smooth and consistent stroke. The head typically has a resonance upon ball strike of several kHz or more. The shaft is thin walled steel expanded to a diameter of 5-15 mm with resonance around 100s of Hz. The attachment between the head and the shaft may be via epoxy or other adhesive or, in some cases, by threading or other mechanical connection. In any case, the connection, inherently or by design, provides very poor transfer of vibration from the head to the shaft. Often, a soft rubber grip is affixed to the shaft, further dampening what little vibration transfer may be present.

While dampening vibrations may be advantageous for full swing clubs, for putters and other partial swing clubs the vibrations caused by striking the ball can serve as useful feedback regarding the quality of stroke. In particular, the amount of shaft vibration can indicate to a player whether or not the desired "sweet spot" on the striking surface contacted the ball. Practically, golfers seek to feel what little vibration is transferred to their hands, by using a smaller club head than is optimal, and by removing any gloves before putting. It would be advantageous to amplify the vibrations caused by the impulse force of striking a ball, but few designs seek to do so. Those few have attempted to transmit vibrations to the hands of the golfer with minimal utility. For example, Rohrer (U.S. Pat. No. 7,140,973) discloses rigid vibration transmitting protrusions in intimate contact with the golfer's hands. Amato (U.S. Pat. No. 4,090,711) discloses a hollow shaft comprising a vibratory spring.

SUMMARY

An aspect of the present disclosure provides for a constrained frequency resonator that may be disposed within a striking implement to amplify the momentum transfer between a head of the implement and a grip section of the implement, thereby amplifying the sensation felt at the grip section upon a strike by the head. One aspect of the present invention provides for a golf putter employed in short, low-speed strokes.

In one implementation, the present disclosure provides a striking implement having a shaft extending between a head and a gripping section, wherein the shaft includes a resonator having material properties and dimensioning tuned to achieve a desired resonant frequency upon impact to the head, and wherein the resonator is configured to transmit vibratory motion caused by the impact from the head to the gripping section at the resonant frequency. The resonator may have at least three-fold symmetry about its axis. The resonator may have a distal end that receives the vibratory motion from the head, a proximal end that delivers the vibratory motion to the gripping section, and a recessed section connecting the distal end to the proximal end, the recessed section having a waist that is narrower than the proximal end and the distal end. The recessed section may include at least one transitional section between the waist and one of the proximal end and the distal end of the resonator. The resonator may have a continuously varying cross-section, and the cross-section may be uniform and and may be circular or elliptical. The resonator may have an hour glass configuration, and may be a metal having a high resistance to plastic deformation.

In another implementation, the present disclosure provides a shaft for a striking implement, the shaft having a distal shaft section coupled to a gripping section by a resonator configured to transmit vibratory motion to the gripping section at a resonant frequency of the resonator. The resonator may have a distal end configured to couple to the distal shaft section and a proximal end configured to couple to one of the gripping section and a proximal shaft section. The resonator may have a recessed section coupling the distal end to the proximal end and being tuned to effect a pre-selected amplitude and frequency band of the vibratory motion transmitted to the gripping section. The pre-selected frequency band may include the resonant frequency. The recessed section of the resonator may include a waist that serves as a node for the vibratory motion. The distal shaft section may be attached by epoxy to a recess in the distal end of the resonator. The distal shaft section may have a tapered section and a straight section, the straight section being cut to a desired length before the distal shaft section is attached to the resonator. The gripping section may be metal, and may include a thin polymer coating.

In yet another implementation, the present disclosure provides a resonator for a striking implement. The resonator may include: a distal end configured to couple to a distal shaft section of the striking implement and to receive an impulse force imparted on the distal shaft section and effecting a vibratory motion in the first end, the vibratory motion having a first amplitude and frequency; a proximal end configured to couple to one of a gripping section and a proximal shaft section of the striking implement; and a recessed section coupling the distal end to the proximal end and tuned to transmit a constrained vibratory motion from the proximal end to the distal end, the constrained vibratory motion having a second amplitude and frequency in which the second frequency includes a resonant frequency of the resonator. The resonator may further include a waist that is narrower than one or both of the proximal and distal ends, a distal transitional section extending from the distal end of the resonator to the waist, and a proximal transitional section extending from the proximal end of the resonator to the waist, the proximal and distal transitional sections each having a slope that determines the width of the frequency band transmitted to the gripping section. The slopes of the proximal and distal transitional sections may be identical, and may be curved. The resonator may have at least three-fold symmetry about its axis, and may further have an hourglass shape.

In yet another implementation, the present disclosure provides a striking implement having a head, a distal shaft fixedly coupled to the head at a distal end of the distal shaft, an hourglass-shaped constrained frequency resonator, and a grip section fixedly coupled to the constrained frequency resonator. The constrained frequency resonator may include a recessed section having a waist and a recess length, a distal resonator mass, and an proximal resonator mass separated from the distal resonator mass by the recessed section. The waist may be located between an proximal section and a distal section of the recessed section, the proximal section extending from the waist to the proximal resonator mass, and the distal section extending from the waist to the distal resonator mass. The distal resonator mass may be fixedly coupled to a proximal end of the distal shaft. T striking implement may have a grip section fixedly coupled to the proximal resonator mass.

The striking implement may be configured as a golf putter, wherein the head is a flat, low-profile putter head employed in short, low-speed strokes. The striking implement may have a loft of below ten degrees. The striking implement may be configured as a pool cue, wherein the head is a cue tip.

The waist may be between 5-15 millimeters. The recess length may be between 0.5 to 8 centimeters. The proximal resonator mass may be between 5 grams and 200 grams. The distal resonator mass may be between 5 grams and 200 grams. The waist may oscillate in a single resonant mode, and the waist may be configured to define the single resonant mode frequency. The waist may oscillate between 100 and 20,000 Hz.

The constrained frequency resonator may be solid, and may be metal. The distal shaft may be hollow, may be metal, and may be tapered defining an proximal diameter and a distal diameter. The grip section may be hollow, may be metal, and may be tapered defining an proximal diameter and a distal diameter. The grip section may include a flat surface and a coating that facilitates a firm hold for a player's hands. The striking may further include a sleeve surrounding the constrained frequency resonator.

BRIEF DESCRIPTION OF DRAWINGS

Embodiments of the invention will now be described, by way of example only, with reference to the accompanying drawings in which corresponding reference symbols indicate corresponding parts.

DETAILED DESCRIPTION

The present disclosure describes a constrained frequency resonator and a striking implement including the constrained frequency resonator for transferring and, advantageously, amplifying momentum from a striking end to a gripped end of the striking implement, thereby amplifying the sensation of a strike felt at the gripped end. The striking implement described herein may be employed in any game or task in which a ball or projectile is impelled across a playing surface or three-dimensional space such as in the games of golf, croquet, billiards, pool, tennis, and so on. An embodiment of the invention relates to the game of golf, and the invention will be described herein with details relating to a golf club, however it should be appreciated that the functional principles of the present invention may be modified and/or altered without departing from the spirit, principles, or scope of the present invention.

Figure 1:
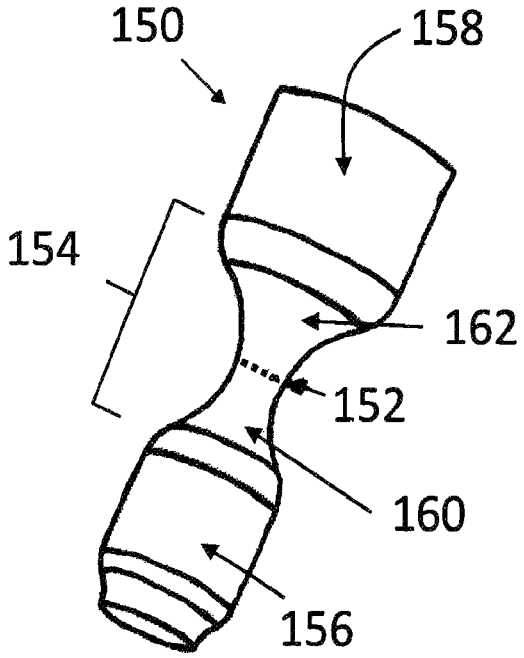
FIG. 1 illustrates an exemplary embodiment of a constrained frequency resonator.

Referring to FIG. 1, an exemplary constrained-frequency resonator 150 may have a distal resonator mass 156 separated from a proximal resonator mass 158 by a vibratory waveamplifying recessed section 154 attached to or integral with both resonator masses 156, 158. The recessed section 154 may include a waist 152 that is the narrowest part of the recessed section 154. The waist 152 may be positioned generally at the axial midpoint of the recessed section 154, and may divide the recessed section 154 into a distal transitional section 160 and a proximal transitional section 162. The proximal transitional section 162 extends from the waist 152 to the proximal resonator mass 158, and the distal transitional section 160 extends from the waist 152 to the distal resonator mass 156. The resonator 150 vibrates in response to an impulse force imparted on one of the resonator masses 156, 158, and the vibration is anchored by the waist 152. That is, due to the width of the waist 152, the vibratory motion is transferred in whole or in part from the impacted resonator mass to the other resonator mass.

The vibration occurs within a band of frequencies at which the waist 152 oscillates in response to the impulse force. The frequency band is constrained around a resonant frequency of the waist 152. The resonant frequency, frequency bandwidth, and relative amplitudes of the frequencies in the frequency band may be influenced by the interaction of several characteristics of the resonator 150, including without limitation: the choice of material(s) for the resonator 150; whether the resonator 150 is solid or partially or completely hollow; the cross-sectional shape and area of the waist 152 in relation to the resonator masses 156, 158; the length of the recessed section 154; the weights of the resonator masses 156, 158; and the length and slope of each transitional section 160, 162. The resonant frequency and bandwidth may further be influenced by the characteristics of the striking implement in which the resonator is integrated, as described below. Furthermore, the waist 152 may affect the amplitude of the vibration transmitted from one resonator mass 156, 158 to the other: the narrower the waist 152 with respect to the resonator masses 156, 158, the larger the amplitude transmitted. The particular dimensions of the waist 152 and resonator masses 156, 158 may be modified to produce a different desired frequency response based on the preferences of a player using the striking implement that includes the resonator 150.

The constrained frequency resonator 150 may be made of any suitable material for producing the desired oscillating waist 152 that will transfer the vibrations from one resonator mass to the other. In an embodiment, the constrained frequency resonator 150 is made essentially of a metal or a metal alloy. For example, the constrained frequency resonator 150 may comprise aluminum, titanium, titanium alloys, nickel, nickel alloys, copper, chromium, zinc, tin, carbon, steel, stainless steel, tool steel, hardened steel (e.g., martensitic stainless steel), brass, bronze, or any other suitable metal and/or alloy. The selection of material may affect the natural frequency and harmonic or contributory frequencies generated by the resonator 150. In particular, as the elastic modulus of the material increases, the natural frequency increases, and as the mass density of the material increases, the natural frequency decreases. Furthermore, the selection of material may depend on the type of striking implement that will incorporate the resonator 150. For example, a suitable material for a resonator 150 to be used in a golf club may have a high resistance to plastic deformation so the club does not excessively bend at the resonator 150 during play. The constrained frequency resonator 150 may be forged, cast, milled or crafted in any other suitable manner.

The resonator 150 may be entirely solid; that is, the resonator 150 may be an essentially continuous mass, lending flexural strength to the resonator 150. Alternatively, the resonator 150 may be partially or completely hollow to reduce its weight or provide a different spectrum of frequency response as compared to a solid resonator 150 of equal dimensions. The waist 152 may be only slightly or substantially narrower than one or both of the resonator masses 156, 158. As the size difference between the waist 152 and the resonator masses 156, 158 increases, the resonator's 150 resonant frequency and its flexural resistance both decrease and the amplitude of the transferred vibrations increases. In non-limiting embodiments, the waist 152 may be between five and 15 millimeters, the length of the recessed section 154 may be between five and 80 millimeters, the resonator masses 156, 158 may be between five grams and 200 grams and between five and 20 millimeters wide, and the resonator masses 156, 158 may have the same or different weights and widths. In other embodiments, the resonator masses 156, 158 may have little or no "excess," mass, and may be essentially hollow with a wall that is the same width as the wall of the shaft with which the resonator 150 integrates, as described below.

The length and slope of the transitional sections 160, 162 affect the width of the frequency band around the resonant frequency that is generated in the resonator 150. Specifically, the greater the slope of each transitional section 160, 162, the fewer frequencies are generated. The slope also affects the amplitude of the frequencies in the frequency band around the resonant frequency, and may be curved (i.e., parabolic or together hyperbolic as illustrated) or linear. In one embodiment, each transitional section 160, 162, may be substantially planar, normally to the axis of the resonator 150, to maximize the slope of the transitional section 160, 162. Such a resonator 150 would produce only the resonant frequency with a very small or nonexistent frequency band around it. In contrast, the curved transitional sections 106, 162 of the illustrated embodiment produce a wider frequency band with frequencies increasing in amplitude as they approach the resonant frequency from higher or lower values.

The resonator 150 may be substantially symmetrical, and in particular may have at least three-fold symmetry about its axis. This degree of symmetry lends flexural strength to the resonator 150, while also providing for the resonator 150 to comply with United States Golf Association (USGA) rules requiring a club shaft to bend in the same way (i.e., to have the same deflection) regardless of the shaft's rotation about its axis. The recessed section 154 of the resonator 150 may have a cross-section of a uniform shape, but that is continuously varying in area along the length of the recessed section 154. The resonator 150 may have a hyperbolic (i.e., hourglass-shaped) outer surface that includes the resonator masses 156, 158 and the recessed section 154, such that a cross-section that is normal to the axis of the resonator 150, taken at any point on the resonator 150, is circular. Alternatively, the resonator 150 may be asymmetrical, such as by having a ellipsis or any other suitable shape in cross-section.

Figure 2:
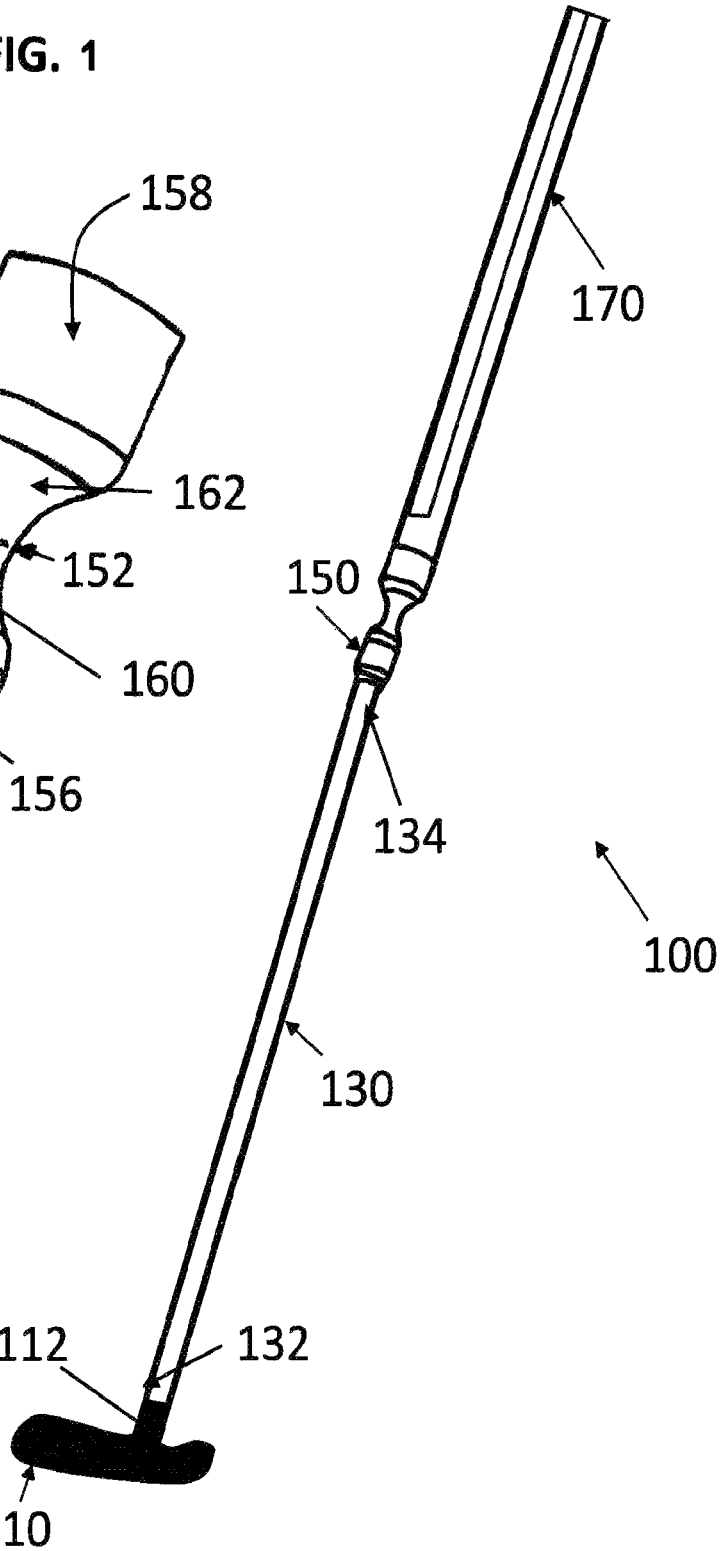
FIG. 2 illustrates an exemplary embodiment of a striking implement including the constrained frequency resonator of FIG. 1.

Referring to FIG. 2, the resonator 150 may be incorporated into a striking implement, such as a golf club 100. In some embodiments, the golf club 100 includes a head 110, a distal shaft 130 attached to the head 100 at a distal end 132 and to the resonator 150 at a proximal end 134, and a grip section 170 attached to the resonator 150. In other embodiments, the striking implement may include a shaft having the distal shaft section 130 and a proximal shaft section (not shown) attached to opposite ends of the resonator 150, the proximal shaft section then attaching to the gripping section 170. In an embodiment, the golf club 100 is particularly provided as a putter used for guiding golf balls short distances under partial, short, low-speed strokes. Accordingly, the head 110 may be provided as a flat, low-profile golf putter head. In an embodiment, the loft, or angle of the face of the putter head 110 to the distal shaft 130, is below ten degrees. However, according to a player's desired golf club characteristics, any suitable head 110 may be employed for any desired type of stroke. In an embodiment of the golf club 100, the waist 152 may oscillate between 100 and 20,000 Hz, and more particularly between about 1000 and about 10,000 Hz. In some embodiments, the waist 152 oscillates in a single resonant mode, which advantageously allows for the design of a series of clubs 100 that each resonate at a different desired frequency (e.g., putters at 5 kHz, 6.5 kHz, 8 kHz, 10 kHz, etc.). The initial amplitude of the vibratory motion that causes the waist 152 to oscillate may depend on the magnitude of the impulse force produced by a strike on the head 110, where a typical impulse force from a putted golf ball is about 10 to 100 N.

The distal shaft 130 comprises a distal end 132 and a proximal end 134. The distal end 132 may be attached to the head 110 at any suitable point. For example, the distal end 132 may be directly attached to the head 110 at the heel of the head 110, or the distal end 132 may attach to a neck 112 of the head 110 as illustrated in FIG. 2. The distal shaft 130 may be fixedly coupled to the head 110. In the description provided herein, the term 'fixedly coupled' may refer to any suitable method or mechanism by which to fasten sections of the striking implement together. For example, fixed coupling may be provided via welding, brazing, forging, screws, fasteners, pinning, casting, gluing, threaded attachment, and so on. A fixed coupling of two members, in particular with reference to the resonator 150 attachments in the shaft, may suffer from minimal or no loss of momentum (i.e., vibratory motion) across the coupling. In some embodiments, the neck 112 may contain features such as an adjustability mechanism or an alignment line. In some embodiments, the neck 112 may include the resonator 150, which may be the sole resonator 150 of the club 100 or may be a second resonator 150 that amplifies the operation of the resonator 150 attached between the distal shaft 130 and the grip section 170. A sleeve (not shown) may cover the resonator 150 in the neck 112 such that the neck 112 does not appear to be unusually shaped.

The distal shaft 130 may have any design suitable for golf clubs, and in particular may satisfy USGA rules. In an embodiment, the distal shaft 130 may be fully or substantially hollow, and may further be tapered with a maximum diameter at the proximal end 134 and a minimum diameter at the distal end 132. The distal shaft 130 may be only partially In some embodiments, the distal shaft 130 may be configured in a bent shape as is advantageously known in the art of putter design. The distal shaft 130 may be of any suitable length, diameter or other dimension, considering that the length of the distal shaft 130 determines the distance of the resonator 150 from the player's hands due to the resonator's 150 attachment to the proximal end 134. The distal shaft 130 may be made of any suitable material. In an embodiment, the distal shaft 130 is made essentially of a metal or a metal alloy. For example, the distal shaft 130 may comprise aluminum, nickel, copper, chromium, zinc, tin, carbon, steel, brass, bronze, or any other suitable metal and/or alloy. The distal shaft 130 may be forged, cast, milled or crafted in any other suitable manner.

The distal resonator mass 156 of the resonator 150 may be fixedly coupled to the proximal end 134 of the distal shaft 130. In an embodiment, the distal shaft section 130 and the resonator 150 are configured to provide a coupled shaft which may be bent in such a way that the deflection is the same regardless of how the shaft is rotated about its longitudinal axis; and twist the same amount in both directions. Accordingly, the shaft is designed to have asymmetric properties, so that however the club is assembled, or whichever way the shaft is oriented, the performance of the club remains unchanged.

The club 100 may include a sleeve (not shown) covering and shielding the resonator 150 from view. The sleeve may be configured so as to give the impression of a continuous shaft such that a casual observer would be unable to distinguish between the distal shaft 130 and the resonator 150 and/or the grip section 170 and the resonator 150. The sleeve may be formed of any suitable material and configuration, so long as the sleeve does not void the vibratory wave amplifying function of the resonator 150.

Figure 3:
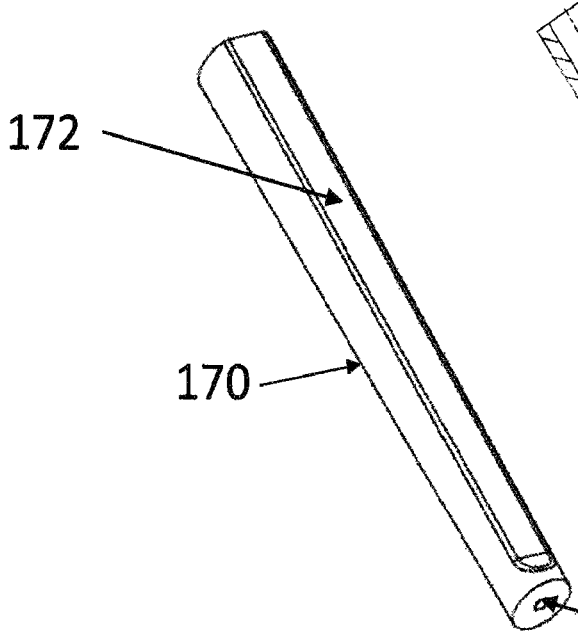
FIG. 3 illustrates a grip section of the example striking implement of FIG. 2.
Figure 4:
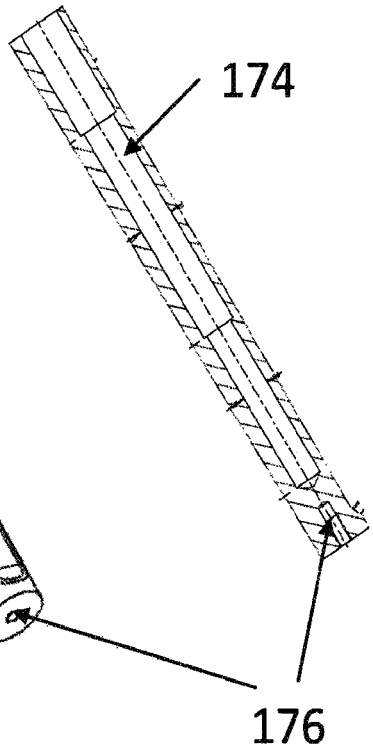
FIG. 4 illustrates a cross-sectional view of the grip section of FIG. 3.

The grip section 170 may be fixedly coupled to the proximal resonator mass 158. Referring to FIGS. 3 and 4, the grip section 170 may comprise a threaded void 176 such that a correspondingly threaded bolt (not shown) extending from the proximal resonator mass 158 may be screwed into the grip section 170. The grip section 170 is the portion of the golf club 100 which is in physical contact with a player's hands during a stroke. In an embodiment, the grip section may have a hollow inner chamber 174 extending partially or fully through the grip section 170 lengthwise, reducing the weight of the grip section 170 and moving the center of mass of the club 100 toward the head 110. The inner chamber 174 may be configured to receive one or more removable weights (not shown) that can be inserted by a player as desired to move the center of mass of the club 100 toward the grip section 170. For example, the inner chamber 174 may be threaded, and the weights may be correspondingly threaded for securing in the inner chamber 174.

In some embodiments, the grip section 170 may have a substantially circular cross-section. In other embodiments, such as that depicted in FIG. 3, the grip section 170 may have at least one flat surface 172. The flat surface 172 may extend across substantially all of the grip section 170 lengthwise, as depicted in FIG. 3, or may extend across a partial segment of the grip section 170. In some embodiments, the grip section 170 may be tapered defining an proximal maximum diameter and a distal minimum diameter. The grip section 170 may be a metal or a metal alloy for facilitating transmission of impact vibrations to a players' hands. For example, the grip section 170 may comprise aluminum, titanium, nickel, copper, chromium, zinc, tin, carbon, steel, brass, bronze, or any other suitable metal and/or alloy. Furthermore, the grip section 170 may be forged, cast, milled or crafted in any other suitable manner.

The grip section 170 may not molded for the hands (i.e., may have at most a single taper to satisfy USGA rules), but may have subtle changes in surface texture to facilitate a firm hold by the players' hands. In some embodiments, the grip section 170 may include a coating principally for the purpose of assisting the player in maintaining a firm hold on the grip section 170, thereby avoiding slipping or twisting of the striking instrument out of the players' hands. For example, a thin coating comprised of a polymer may be employed for the comfort of a player's hand. In some embodiments, a grip coating may be selected to modulate the vibratory amplification provided by the constrained frequency resonator 150. A thin coating, which may be a softer material than the material of the grip section 170, may allow the resonant frequency of the resonator 150 to pass through the coating into the player's hands, while filtering out some or all unwanted (i.e., harmonic, contributory, and the like) frequencies generated by the resonator 150.

Figure 5:
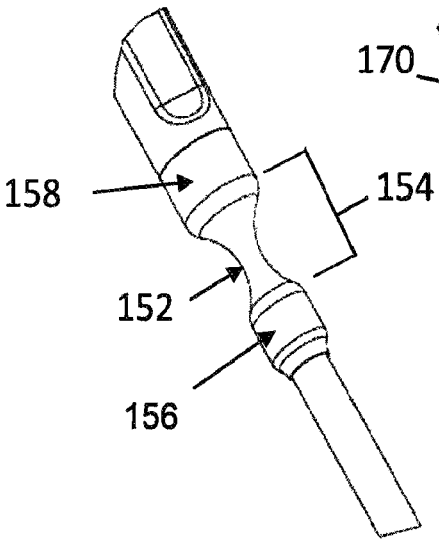
FIG. 5 illustrates the constrained frequency resonator of the example striking implement of FIG. 2.
Figure 6:
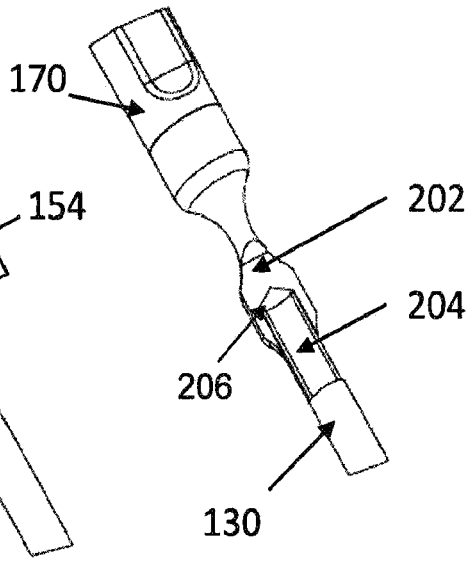
FIG. 6 is a cross-sectional view of the constrained frequency resonator of FIG. 5.

Referring to FIGS. 5 and 6, the resonator 150 may differ from the distal shaft 130 and grip section 170 in that the resonator 150 is solid (see solid area 202 of the resonator 150), while the distal shaft 130 and grip section 170 are both essentially hollow (see hollow area 204 of the distal shaft 130). The length of the striking implement may be varied according to player height and/or preference. For example, the grip section 170 and resonator 150 together may be initially provided as a first assembly. The distal shaft 130 may be provided as a second assembly. As a non-limiting example, the distal shaft 130 may be initially provided as having a generally long length (e.g., ten inches) with a section at the proximal end 134 having constant diameter, whether or not the distal shaft 130 is tapered toward the distal end 132. During a subsequent fitting process to tailor the striking implement to player height and/or preference, the distal shaft 130 may be cut to the desired length and fixedly coupled (e.g., epoxied) into a recess 206 of the distal resonator mass 156. Any other suitable mechanism for setting the length of striking implement may be employed based on player preference and/or manufacturing constraints.

In operation, the constrained frequency resonator 150 provides a node at the waist 152, which was previously nonexistent in the shaft of the club 100. The resonator 150 thereby amplifies momentum transfer between the head 110 and the metal grip section 170 at the resonator's 150 resonant frequency, allowing a golf ball strike to be felt by a players' hands in contact with the metal grip 170 section. The resonant frequency may be tuned by changing the characteristics of the resonator 150, so that the "feel" of the club 100 conforms to a player's preference. Furthermore, the resonator 150 may amplify and transfer a torque on the head 110 caused by mis-hitting the golf ball toward the toe or heel of the head 110. Through repetitive use of the club 100 (and any striking implement in accordance with the present disclosure), a player can develop a coordinated recognition of the feel in his hands upon striking and the quality of the stroke. For example, the player will recognize that the "sweet spot" of the club 100 face was struck if a certain vibration, but no torque, is felt in the hands; in contrast, a clockwise or counter-clockwise torque in the club 100 face may be amplified by the resonator 150 and felt in the hands as an indicator that the ball was mis-hit.

It may be appreciated that a typical golf club decouples the head 110 mass from the "feel" in the players' hands at the metal grip section 170. Thus, while the optimal putter would have a heavy head 110, the heavier the head 110, the less feel at the grip section 170 of typical putters. In contrast, the presently described club 100 provides a heavy head 110 in the players' hands with ball "feeling," thus delivering an optimal combination.

Within a striking implement as described herein, several factors may contribute to the natural frequency of the resonator 150. These include the characteristics of the resonator 150 as described above, as well as the characteristics of the striking implement, including without limitation: head mass and density; shaft length, stiffness, mass, density (hollow or solid), and material; and the mass of the grip section. Each of these characteristics may be selected in order to adapt the striking implement to the particular game to be played, and further to the particular player, if desired.

Embodiments of a striking implement for impelling a ball across a playing surface in accordance with the present disclosure may include: a head; a distal shaft having a distal end and a proximal end and being fixedly coupled to the head at the distal end; an hourglass-shaped constrained frequency resonator including a recessed section having a waist and a recess length, a distal resonator mass, and a proximal resonator mass, the waist being located between an proximal section and a distal section of the recessed section, the proximal section extending from the waist to the proximal resonator mass, the distal section extending from the waist to the distal resonator mass, and the distal resonator mass being fixedly coupled to the proximal end of the distal shaft; and a grip section fixedly coupled to the proximal resonator mass. In an embodiment, the striking implement is configured as a golf putter, and the head is a flat, low-profile putter head employed in short, low-speed strokes. A loft of the striking implement may be below 10 degrees. In an embodiment, the striking implement is configured as a pool cue, and the head is a cue tip. The waist may be between 5 and 15 millimeters. The recess length may be between 0.5 and 8 centimeters. The proximal resonator mass may be between 5 grams and 200 grams. The distal resonator mass may be between 5 grams and 200 grams. In an embodiment, the waist oscillates in a single resonant mode, and the waist is configured to define the single resonant mode frequency. In an embodiment, the waist oscillates between 100 and 20,000 Hz. The constrained frequency resonator may be solid and/or metal. One or both of the distal shaft and the grip section may be one or more of hollow, metal, and tapered. The grip section may include a flat surface. The grip section may comprise a coating that facilitates a firm hold for a player's hands. In an embodiment, the striking implement includes a sleeve surrounding the constrained frequency resonator.

The foregoing illustrated embodiments have been provided solely for illustrating the functional principles of the present invention and are not intended to be limiting. For example, the present invention may be practiced using different overall structural configuration and materials. Persons skilled in the art will appreciate that modifications and alterations of the embodiments described herein can be made without departing from the spirit, principles, or scope of the present invention. The present invention is intended to encompass all modifications, substitutions, alterations, and equivalents within the spirit and scope of the following appended claims.

The invention claimed is:

1. A striking implement having a shaft extending between a head and a gripping section, wherein the shaft includes a resonator having material properties and dimensioning tuned to resonate at a desired resonant frequency upon impact to the head, and wherein the resonator amplifies and transmits vibratory motion caused by the impact from the head to the gripping section at the resonant frequency, wherein amplifying, by the resonator, the vibratory motion increases an amplitude of the vibratory motion occurring at the resonant frequency.

2. The striking implement of claim 1, wherein the resonator has at least three-fold symmetry about its axis.

3. The striking implement of claim 1, wherein the resonator comprises a distal end that receives the vibratory motion from the head, a proximal end that delivers the vibratory motion to the gripping section, and a recessed section connecting the distal end to the proximal end, the recessed section having a waist that is narrower than the proximal end and the distal end.

4. The striking implement of claim 3, wherein the recessed section includes at least one transitional section between the waist and one of the proximal end and the distal end of the resonator.

5. The striking implement of claim 4, wherein the transitional section has a continuously varying cross-section.

6. The striking implement of claim 3, wherein the recessed section has a continuously varying cross-section between the proximal end and the distal end of the resonator.

7. The striking implement of claim 3, wherein a cross-section of the recessed section is uniform and is at least one of circular and elliptical.

8. The striking implement of claim 1, wherein the resonator has an hour glass configuration.

9. The striking implement of claim 1, wherein the resonator is a metal having a high resistance to plastic deformation.

10. A shaft for a striking implement, the shaft having a distal shaft section coupled to a gripping section by a resonator that amplifies and transmits vibratory motion to the gripping section at a resonant frequency of the resonator, wherein an amplitude of the vibratory motion occurring at the resonant frequency is increased by the resonator, wherein the resonator has a distal end configured to couple to the distal shaft section and a proximal end configured to couple to one of the gripping section and a proximal shaft section, and wherein the resonator has a recessed section coupling the distal end to the proximal end and being tuned to effect a pre-selected amplitude and frequency band of the vibratory motion transmitted to the gripping section, the pre-selected frequency band including the resonant frequency.

11. The shaft of claim 10, wherein the recessed section of the resonator includes a waist that serves as a node for the vibratory motion.

12. The shaft of claim 10, wherein the distal shaft section is attached by epoxy to a recess in the distal end of the resonator.

13. The shaft of claim 12, wherein the distal shaft section has a tapered section and a straight section, the straight section being cut to a desired length before the distal shaft section is attached to the resonator.

14. The shaft of claim 10, wherein the gripping section is metal and comprises a thin polymer coating.

15. A resonator for a striking implement, the resonator comprising:

a distal end configured to couple to a distal shaft section of the striking implement and to receive an impulse force imparted on the distal shaft section and effecting a vibratory motion in the distal end, the vibratory motion having a first amplitude and frequency, the distal end having a first width;

a proximal end configured to couple to one of a gripping section and a proximal shaft section of the striking implement, the proximal end having a second width;

a recessed section coupling the distal end to the proximal end and tuned to amplify and transmit a constrained vibratory motion from the distal end to the proximal end, the constrained vibratory motion having a second amplitude that is increased by the resonator and a second frequency in which the second frequency includes a resonant frequency of the resonator; and a waist having a third width, wherein the third width of the waist is inversely proportional to the second amplitude of the amplified and transmitted constrained vibratory motion.

16. The resonator of claim 15, wherein the third width of the waist is narrower than one or both of first and second widths, and wherein the resonator further comprises:

a distal transitional section extending from the distal end of the resonator to the waist; and a proximal transitional section extending from the proximal end of the resonator to the waist, the proximal and distal transitional sections each having a slope that determines the width of the frequency band transmitted to the gripping section.

17. The resonator of claim 16, wherein the slopes of the proximal and distal transitional sections are identical.

18. The resonator of claim 16, wherein the slopes of the proximal and distal transitional sections are curved.

19. The resonator of claim 18 having at least three-fold symmetry about its axis.

20. The resonator of claim 19 having an hourglass shape.

* * * * *